US009176416B2

(12) United States Patent
Satoh

(10) Patent No.: US 9,176,416 B2
(45) Date of Patent: Nov. 3, 2015

(54) CHARGING DEVICE, IMAGE FORMING APPARATUS AND IMAGE FORMING METHOD

(71) Applicant: Makoto Satoh, Kanagawa (JP)

(72) Inventor: Makoto Satoh, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/554,683

(22) Filed: Nov. 26, 2014

(65) Prior Publication Data

US 2015/0177637 A1 Jun. 25, 2015

(30) Foreign Application Priority Data

Dec. 25, 2013 (JP) ..... 2013-267713

(51) Int. Cl.
*G03G 15/02* (2006.01)
*G03G 15/00* (2006.01)

(52) U.S. Cl.
CPC ..... *G03G 15/0266* (2013.01); *G03G 15/0291* (2013.01); *G03G 15/5037* (2013.01); *G03G 2215/027* (2013.01)

(58) Field of Classification Search
CPC ..... G03G 15/0266; G03G 15/0291
See application file for complete search history.

(56) References Cited

U.S. PATENT DOCUMENTS

2005/0200309 A1* 9/2005 Kamiya ..... 315/291
2010/0080593 A1* 4/2010 Inukai et al. ..... 399/50
2010/0158558 A1* 6/2010 Hano ..... 399/100
2012/0195616 A1* 8/2012 Miyahara ..... 399/55

FOREIGN PATENT DOCUMENTS

JP 04-163565 6/1992
JP 2010-181737 8/2010

* cited by examiner

*Primary Examiner* — David Gray
*Assistant Examiner* — Carla Therrien
(74) *Attorney, Agent, or Firm* — Oblon, McClelland, Maier & Neustadt, L.L.P.

(57) ABSTRACT

A charging device according to an embodiment includes a surface potential sensor configured to output a result of detecting a surface potential of a photoconductor, on which charge is deposited by the charging device, of an image forming apparatus and a main control unit. The main control unit is configured to perform a charging-current determining process which determines a charging-current setpoint value, which is an output setpoint value for constant current control of a charging bias to be fed from a corona power supply, based on a difference between the result of detection output from the surface potential sensor and a grid setpoint value, which is an output setpoint value for constant voltage control of a grid bias to be fed from a grid power supply, at predetermined timing.

7 Claims, 10 Drawing Sheets

CHARGING DEVICE, IMAGE FORMING APPARATUS AND IMAGE FORMING METHOD

CROSS-REFERENCE TO RELATED APPLICATIONS

The present application claims priority to and incorporates by reference the entire contents of Japanese Patent Application No. 2013-267713 filed in Japan on Dec. 25, 2013.

BACKGROUND OF THE INVENTION

1. Field of the Invention

Embodiments of the present invention relate to a charging device configured to deposit charge on a surface of a latent-image bearer by establishing an electric discharge between a discharge electrode, to which a charging bias is applied, and the latent-image bearer through a grid electrode, to which a grid bias is applied. Some embodiments relate to an image forming method and an image forming apparatus such as a copier, a facsimile, or a printer configured to deposit charge on a latent-image bearer, which is a to-be-charged member, using the charging device.

2. Description of the Related Art

Known examples of this type of image forming apparatus include an image forming apparatus disclosed in Japanese Laid-open Patent Application No. H4-163565. The image forming apparatus deposits charge uniformly on a surface of a photoconductor, which is a latent-image bearer, using a charging device and thereafter optically writes an electrostatic latent image to the charged surface of the photoconductor using an optical scanning system. The image forming apparatus obtains a toner image by developing the electrostatic latent image with toner and transfers the toner image from the photoconductor onto a recording sheet. The charging device includes a corona electrode, which is a discharge electrode, and a grid electrode arranged between the corona electrode and the photoconductor. The charging device further includes a corona power supply, which is a charging power supply for feeding a charging bias to be applied to the corona electrode, and a grid power supply for feeding a grid bias to be applied to the lattice-like grid electrode with constant voltage control. The charging device establishes a discharge between the corona electrode and the photoconductor through the grid electrode, thereby depositing charge uniformly on the surface of the photoconductor. During an initial operation at power ON, a control unit performs a determining process of determining an output setpoint value for the constant voltage control of the grid bias in the following manner to deposit charge on the surface of the photoconductor to a desired potential over a long period. More specifically, an amount of electric current flowing from the corona electrode to the photoconductor is detected. The output setpoint value for the constant voltage control of the grid bias, which allows charging the photoconductor to the desired potential, is determined based on a result of the detection. The determined output setpoint value is used in subsequent charging.

The reason why the output setpoint value for the constant voltage control of the grid bias is determined in this manner is as follows. That is, the longer the photoconductor is used, the more a surface layer of the photoconductor is worn, causing charging performance of the photoconductor to deteriorate. Accordingly, with a configuration which simply maintains the output setpoint value for the constant voltage control of the grid bias constant, the charging potential of the photoconductor drops with time as the surface layer of the photoconductor is worn and adversely affects an image. In contrast, with a configuration in which, as in the image forming apparatus disclosed in Japanese Laid-open Patent Application No. H4-163565, the determining process described above is performed at power ON, the photoconductor can be charged to a desired charging potential even when the surface layer of the photoconductor is worn to some degree.

Meanwhile, Japanese Laid-open Patent Application No. 2010-181737 discloses an image forming apparatus configured as follows. The image forming apparatus causes, as does the image forming apparatus disclosed in Japanese Laid-open Patent Application No. H4-163565, a grid power supply to feed a grid bias with constant voltage control and a corona power supply to feed a charging bias to be applied to a corona electrode with constant current control. However, in contrast to the image forming apparatus disclosed in Japanese Laid-open Patent Application No. H4-163565, the image forming apparatus disclosed in Japanese Laid-open Patent Application No. 2010-181737 maintains an output setpoint value for the constant voltage control of the grid bias constant over a long period. The image forming apparatus increases an output setpoint value for the constant current control in such a manner that the output setpoint value increases with an increase in a measurement result of a physical quantity which is proportional to the thickness of a surface layer of a photoconductor. Examples of the physical quantity include a cumulative number of revolutions of the photoconductor.

With this configuration, it is expected that the image forming apparatus disclosed in Japanese Laid-open Patent Application No. 2010-181737 can deposit charge on the photoconductor to a desired charging potential stably while avoiding generation of unnecessary ozone and waste of energy in contrast to the image forming apparatus disclosed in Japanese Laid-open Patent Application No. H4-163565. More specifically, after the surface layer of the photoconductor is worn to a certain degree, even if the output setpoint value for the constant voltage control of the grid bias is adjusted, the charging potential cannot be increased to a target value unless a relatively large amount of electric current is supplied to the corona electrode. The image forming apparatus disclosed in Japanese Laid-open Patent Application No. H4-163565 requires that the output setpoint value for the constant voltage control of the grid bias be set to a relatively large value so that the photoconductor can be charged to the target charging potential even if the surface layer of the photoconductor is worn near to the end of its usable life. However, if the output setpoint value is set to such a value, in a state where the surface layer of the photoconductor is hardly worn and therefore the photoconductor delivers sufficient charging performance, a charging current larger than a necessary amount is fed to the photoconductor, resulting in generation of unnecessary ozone and waste of energy. In contrast, the image forming apparatus disclosed in Japanese Laid-open Patent Application No. 2010-181737 is capable of setting the output setpoint value for the constant current control of the charging bias to an appropriate value depending on the degree of wear of the surface layer of the photoconductor. Accordingly, the image forming apparatus is capable of depositing charge on the photoconductor to a desired charging potential while avoiding generation of unnecessary ozone and waste of energy when the surface layer of the photoconductor is not worn severely.

However, the image forming apparatus disclosed in Japanese Laid-open Patent Application No. 2010-181737 is disadvantageously prone to insufficient image density in a low-temperature and low-humidity environment. More specifically, when an environment changes to a low-temperature and low-humidity environment, electrical resistance of the surface layer of the photoconductor increases, and the potential of an electrostatic latent image formed by optical writing onto the photoconductor is increased to be higher than that in a normal-temperature and normal-humidity environment. As a result, a developing potential, which is the difference between a potential at a developer bearer such as a developing roller and a potential at the electrostatic latent image, drops, resulting in insufficient image density.

Under the circumstances, there is a need for a charging device described below, an image forming apparatus including the charging device and an image forming method. The charging device is capable of depositing charge on an electrostatic latent bearer to a desired charging potential while avoiding generation of unnecessary ozone and waste of energy and, simultaneously, obtaining stable image density independently of an environment.

It is an object of the present invention to at least partially solve the problems in the conventional technology.

SUMMARY OF THE INVENTION

It is an object of the present invention to at least partially solve the problems in the conventional technology.

According to the present invention, there is provided a charging device comprising: a discharge electrode for establishing a discharge; a grid electrode arranged between the discharge electrode and a latent-image bearer of an image forming apparatus; a charging power supply configured to feed, with constant current control, a charging bias to be applied to the discharge electrode to deposit charge on a surface of the latent-image bearer by establishing the discharge between the discharge electrode and the latent-image bearer; a grid power supply configured to feed a grid bias to be applied to the grid electrode with constant voltage control; and a control unit configured to perform a grid determining process, the grid determining process determining a grid setpoint value, the grid setpoint value being an output setpoint value for the constant voltage control of the grid bias, characterized in further comprising a surface potential detector configured to output a result of detecting a surface potential of the latent-image bearer where charge is deposited by the discharge, wherein the control unit is configured to perform a charging-current determining process, the charging-current determining process determining a charging-current setpoint value, the charging-current setpoint value being an output setpoint value for the constant current control of the charging bias, based on a difference between the result of detection output from the surface potential detector and the grid setpoint value at predetermined timing.

The present invention also provides an image forming apparatus comprising: a latent-image bearer; a charging unit configured to deposit charge on the latent-image bearer; a latent-image writing unit configured to write a latent image to the charged latent-image bearer; and a developing unit configured to develop the latent image, the image forming apparatus being characterized in using the charging device mentioned at above paragraph as the charging unit.

The present invention also provides an image forming method comprising: charging a latent-image bearer; writing a latent image to the charged latent-image bearer; and developing the latent image, wherein the charging is performed using the above-mentioned charging device.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 3 is a configuration diagram illustrating a charging device of the printer with a photoconductor and the like;

DETAILED DESCRIPTION OF THE PREFERRED EMBODIMENTS

Exemplary embodiments of the present invention are described below. According to an embodiment, an image forming apparatus according to an aspect of the present invention is implemented as a printer which forms images by electrophotography. The printer according to the embodiment described below is merely an example of an image forming apparatus according to an aspect of the present invention, and implementation of the present invention is not limited to the embodiment of the printer.

Figure 1:
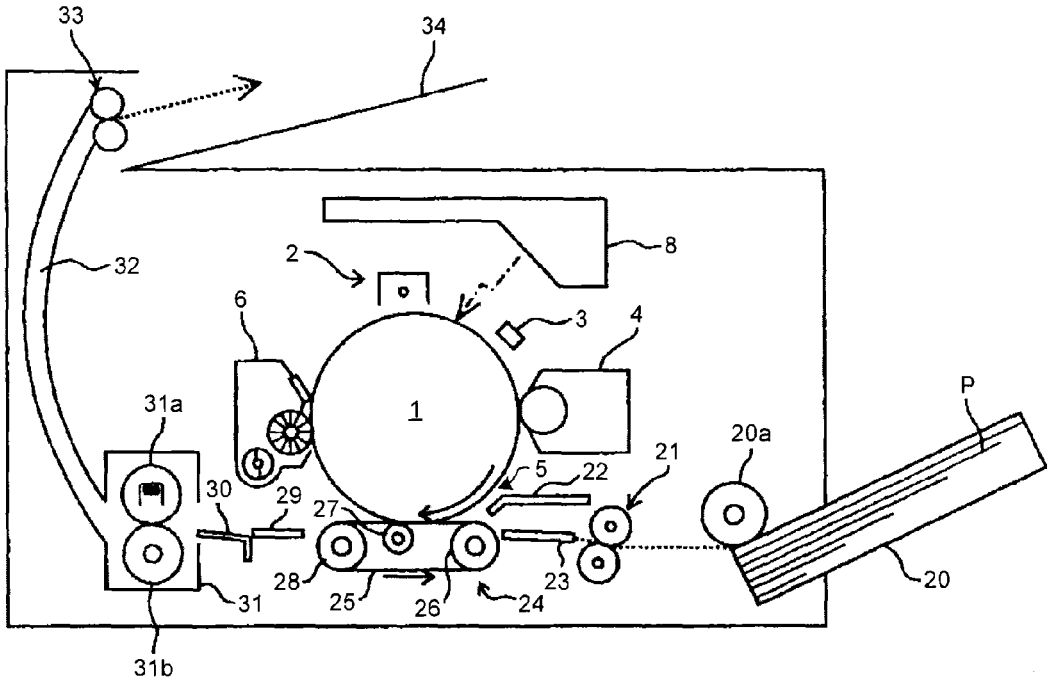
FIG. 1 is a schematic configuration diagram illustrating a printer according to an embodiment of the present invention.

FIG. 1 is a schematic configuration diagram illustrating a printer according to an embodiment. The printer according to the embodiment includes a drum-shaped photoconductor 1, a charger unit 2 belonging to a charging device 200 (FIG. 3), a surface potential sensor 3, a developing device 4, a transfer device 5, a static-neutralizing cleaning device 6, a pair of registration rollers 21, and an optical writing device 8. The printer further includes a paper feeding cassette 20, a conveying belt unit 24, a fixing device 31, a paper ejection path 32, a pair of paper ejection rollers 33, and a paper ejection tray 34. In addition, the transfer device 5 is consisted of a transfer roller 27, a conveying belt unit 24, and the rest.

The drum-shaped photoconductor 1 includes an organic photoconductive layer on a surface of a drum base and is driven by a drive unit (not shown) to rotate clockwise in FIG. 1. The charger unit 2 of the charging device, the surface potential sensor 3, the developing device 4, the transfer roller 27, the static-neutralizing cleaning device 6, and the like are arranged around the photoconductor 1.

The charger unit 2 of the charging device 200 is arranged to face the photoconductor 1 with a predetermined gap therebetween. The charger unit 2 deposits charge uniformly on the surface of the photoconductor 1 that is driven to rotate. The printer according to the embodiment employs a scorotron type charger as the charger unit 2 which deposits charge on the photoconductor 1.

The surface of the photoconductor 1 where charge is uniformly deposited by the charger unit 2 of the charging device 200 is optically scanned at an optical scanning position by writing light L emitted from the optical writing device 8. Potential in a region, which is a portion of whole area of circumferential surface of the photoconductor 1, irradiated by the writing light L in the optical scanning drops and bears an electrostatic latent image.

The surface potential sensor 3 is a surface potential detector which detects a surface potential of the photoconductor 1 by a known technique. The surface potential sensor 3 detects a surface potential of the region, which is the portion of the whole area of circumferential surface of the photoconductor 1, passed over a facing position where the region faces the charger unit 2 and then passed over the optical scanning position. The charging potential $V_D$ of a background portion of the photoconductor 1 can be detected using the surface potential sensor 3 by causing the charger unit 2 to deposit charge on the surface of the photoconductor 1 which is not optically scanned by the optical writing device 8. A latent image potential $V_L$ of the photoconductor 1 can be detected using the surface potential sensor 3 by causing the charger unit 2 to perform a charging process and causing the optical writing device 8 to perform a solid-latent-image writing process. The surface potential sensor 3 outputs results of detecting the potentials to a control unit (not shown).

The surface of the photoconductor 1 having passed over the facing position where the surface faces the surface potential sensor 3 is advanced to a position where the surface faces the developing device 4 by rotation of the photoconductor 1. The developing device 4 is a known one-component developing device or a known two-component developing device. The developing device 4 develops an electrostatic latent image on the photoconductor 1 by causing toner to adhere to the electrostatic latent image at a region where the developing device 4 faces the photoconductor 1, thereby obtaining a toner image. The toner image obtained by development in this manner is advanced by rotation of the photoconductor 1 to a transfer nip formed by the photoconductor 1 and a conveying belt 25, which will be described later, contacting each other.

The conveying belt unit 24 including the endless conveying belt 25, a driven roller 26, the transfer roller 27, and a drive roller 28 is arranged below the photoconductor 1. The conveying belt unit 24 moves the conveying belt 25 supported by and stretched between the driven roller 26 and the drive roller 28 in an endless loop counterclockwise in FIG. 1 by driving rotation of the drive roller 28. The transfer roller 27, to which a transfer bias is applied by a transfer bias supply 12 (FIG. 2), is arranged in the loop of the conveying belt 25 which may be made of a rubber belt. The conveying belt unit 24 forms the transfer nip by bringing a portion stretched between the driven roller 26 and the transfer roller 27 of the whole circumferential area of the conveying belt 25 into contact with the photoconductor 1.

The paper feeding cassette 20 is attached to a printer body. The paper feeding cassette 20 houses multiple recording sheets P of recording paper or the like as a sheet bundle formed by overlaying the recording sheets P on one another. A paper feeding roller 20*a* is in contact with an uppermost one of the recording sheets P of the sheet bundle housed in the paper feeding cassette 20. The paper feeding roller 20*a* is driven to rotate in accordance with predetermined timing, thereby delivering the recording sheet P from the paper feeding cassette 20 onto a paper feeding path.

The pair of registration rollers 21, which is a pair of registration rollers to be rotated in contact with each other, is arranged near a downstream end of the paper feeding path. The pair of registration rollers 21 is configured to temporarily stop rotating when the recording sheet P abuts on a registration nip between the pair of registration rollers 21. The pair of registration rollers 21 starts rotating again to deliver the recording sheet P to the transfer nip with timing controlled so as to overlay the recording sheet P onto the toner image on the photoconductor 1 at a transfer portion.

The recording sheet P delivered by the pair of registration rollers 21 is advanced to between an upper pre-nip guide plate 22 and a lower pre-nip guide plate 23 which guide the recording sheet P to deliver the recording sheet P into the transfer nip. A transfer electric field, which electrostatically transfers the toner from the photoconductor 1 to the recording sheet P, is produced between the recording sheet P delivered into the transfer nip and the electrostatic latent image on the photoconductor 1 in the transfer nip. The toner image on the photoconductor 1 is transferred by action of the transfer electric field onto the surface of the recording sheet P delivered into the transfer nip.

The recording sheet P passed through the transfer nip passes over a nip-exit guide plate 29 and then over a pre-fixing guide plate 30, and thereafter enters the fixing device 31. The fixing device 31 includes a fixing roller 31*a*, which internally includes a heat source such as a halogen heater, and a pressure roller 31*b* to be pressed by the fixing roller 31*a*. A fixing nip is formed between the fixing roller 31*a* and the pressure roller 31*b* contacting each other. The recording sheet P delivered into the fixing device 31 receives, in the fixing nip, heat and pressure which fix the toner image on the surface of the recording sheet P.

After passing through the transfer nip, the surface of the photoconductor 1 is advanced to a position where the surface faces the static-neutralizing cleaning device 6. The static-neutralizing cleaning device 6 includes a static-neutralizing lamp (not shown) and a cleaning member (not shown). Residual toner adhering to the surface of the photoconductor 1 after the transfer is removed from the surface of the photoconductor 1 by a doctor blade or a cleaning brush roller, which is driven to rotate. The static-neutralizing lamp irradiates the surface of the photoconductor 1 with static-neutralizing light, thereby electrostatically neutralizing the surface of the photoconductor 1. The charger unit 2 of the charging device 200 deposits charge uniformly on the neutralized surface of the photoconductor 1 again as preparation for next latent image formation.

After passing through the fixing device 31, the recording sheet P is ejected out of the apparatus via the paper ejection path 32 and a paper ejection nip between the pair of paper ejection rollers 33. The recording sheet P is stacked on the paper ejection tray 34 arranged outside the apparatus.

Figure 2:
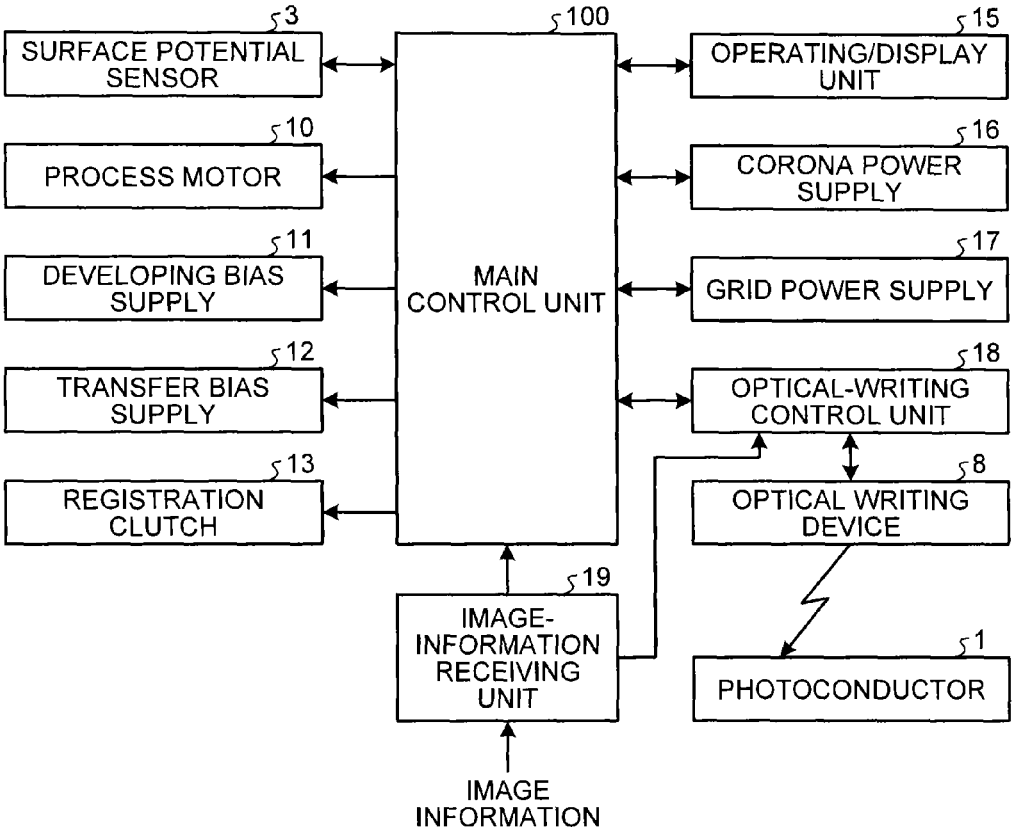
FIG. 2 is a block diagram illustrating a part of electric circuitry of the printer.

FIG. 2 is a block diagram illustrating a part of electric circuitry of the printer according to the embodiment. Referring to FIG. 2, a main control unit 100 which provides driving control of devices in the printer includes a CPU (central processing unit), a RAM (random access memory) which is a data storage unit, and a ROM (read only memory) which is a data storage unit. The main control unit 100 provides driving control of the devices and performs predetermined computations according to a program(s) stored in the ROM.

The surface potential sensor 3, a process motor 10, a developing bias supply 11, a transfer bias supply 12, a registration clutch 13, and the like are connected to the main control unit 100. An operating/display unit 15, a corona power supply 16 which is a charging power supply, a grid power supply 17, an optical-writing control unit 18, an image-information receiving unit 19, and the like are also connected to the main control unit 100.

The image-information receiving unit 19 receives image information from a personal computer (not shown) or a scanner (not shown) operated by a user and passes the image information to the main control unit 100 and the optical-writing control unit 18. The optical-writing control unit 18 optically scans the surface of the photoconductor 1 by providing driving control of the optical writing device 8 based on the image information transmitted from the image-information receiving unit 19. Examples of the optical writing device 8 which performs optical writing to the photoconductor 1 with writing light L (not shown) include a known laser-writing optical system and an LED array.

The process motor 10 is a motor serving as a driving source of the photoconductor 1, the developing device 4, various rollers, and the like. Rotational driving force of the process motor 10 is transmitted to the pair of registration rollers 21 via the registration clutch 13. The main control unit 100 engages the registration clutch 13 at appropriate time, thereby connecting the rotational driving force of the process motor 10 to the pair of registration rollers 21.

The developing device 4 operates to cause the toner carried on a surface of a developing roller (not shown) to adhere to an electrostatic latent image on the photoconductor 1. A developing bias $V_B$, which is identical in polarity to the toner and of which absolute value is higher than an absolute value of the latent image potential $V_L$ and lower than an absolute value of the charging potential $V_D$ of the background portion of the photoconductor 1, is applied to the developing roller to cause the toner to selectively adhere only to the electrostatic latent image which occupies a part of the whole surface of the photoconductor 1. For instance, a developing bias of −550 V may be applied to the developing roller in a condition where the potential of the background portion of the photoconductor is −800 V and the potential of the electrostatic latent image is −30 V. The developing bias supply 11 is configured to feed such a developing bias. The main control unit 100 sends an output command signal to the developing bias supply 11, thereby causing the developing bias supply 11 to feed the developing bias $V_B$ at desired time.

The main control unit 100 sends an output command signal to the transfer bias supply 12 at desired time, thereby causing the transfer bias supply 12 to feed a transfer bias. The transfer bias is a voltage applied to produce the transfer electric field between the recording sheet P and the electrostatic latent image on the photoconductor 1 at the transfer portion where the transfer device 5 that is consisted of the transfer roller 27, the conveying belt unit 24, and the rest faces the photoconductor 1.

The operating/display unit 15, which includes a touch panel (not shown) and a numeric keypad (not shown), is configured to display an image on the touch panel and transmit information entered using the touch panel, the numeric keypad and/or the like to the main control unit 100.

Result of detecting, by the surface potential sensor 3, the surface potential of the photoconductor 1 is transmitted to the main control unit 100 as a digital signal.

Figure 3:
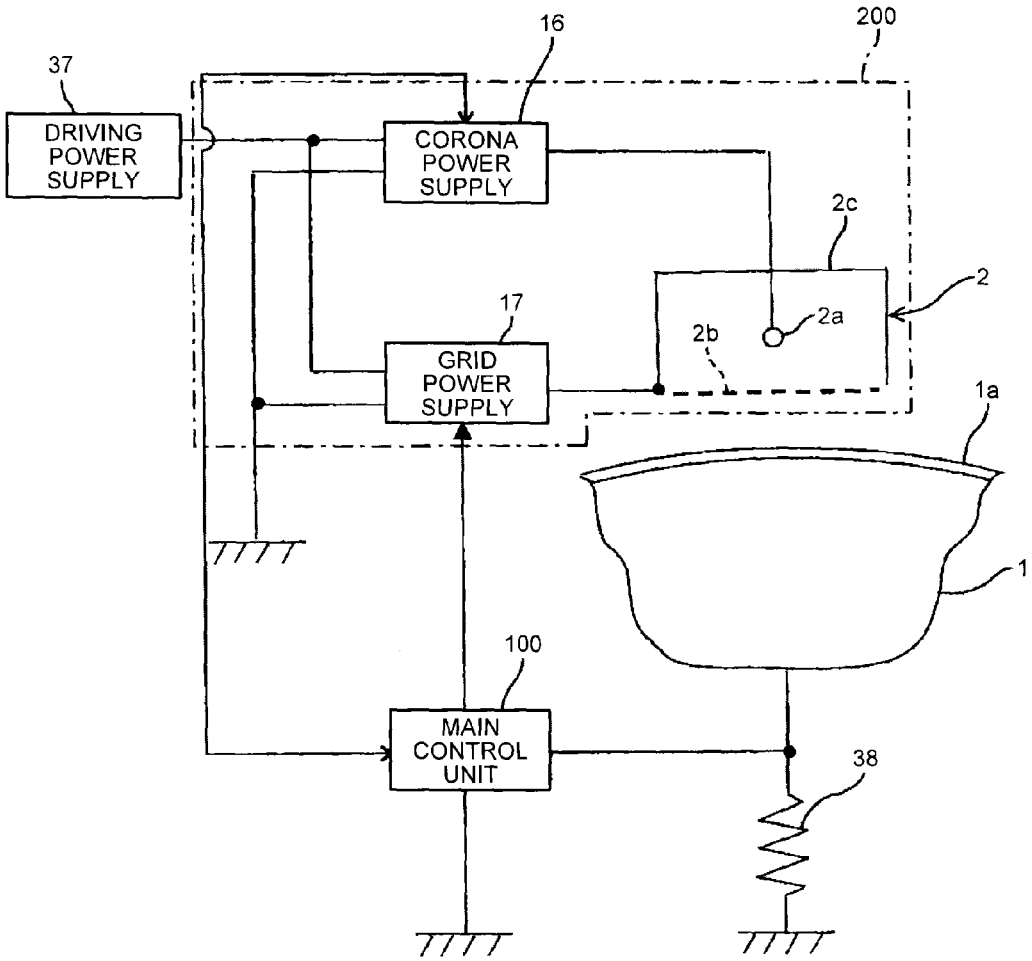

FIG. 3 is a configuration diagram illustrating the charging device 200 of the printer with the photoconductor 1 and the like. The charging device 200 includes the charger unit 2, the corona power supply 16, and the grid power supply 17. The charger unit 2 includes a corona wire 2*a* which is a discharge electrode, a mesh-like grid electrode 2*b*, and a casing 2*c*. The corona wire 2*a* is supported and stretched in the casing 2*c* to establish a discharge between the corona wire 2*a* and the photoconductor 1. The mesh-like grid electrode 2*b* located between the corona wire 2*a* and the photoconductor 1 is stretched across an opening defined in a bottom surface of the casing 2*c*.

The corona power supply 16 and the grid power supply 17 are connected to a driving power supply 37 which feeds a DC (direct current) bias. The corona power supply 16 converts the DC bias fed from the driving power supply 37 into a DC bias which differs from the DC bias fed from the driving power supply 37 in electric current value and outputs the converted DC bias as a charging bias $V_C$ with constant current control. The charging-current setpoint value $A_{CS}$, which is an output setpoint value for the constant current control of the corona power supply 16, is set to a desired value in accordance with a control signal fed from the main control unit 100. The charging bias $V_C$ fed from the corona power supply 16 with constant current control is applied to the corona wire 2*a*.

The grid power supply 17 converts the DC bias fed from the driving power supply 37 into a DC bias which differs from the DC bias fed from the driving power supply 37 in voltage value and outputs the converted DC bias as a grid bias $V_G$ with constant voltage control. The grid setpoint value $V_{GS}$, which is an output setpoint value for the constant voltage control of the grid power supply 17, is set to a desired value in accordance with a control signal fed from the main control unit 100. The grid bias $V_G$ fed from the grid power supply 17 with constant voltage control is applied to the grid electrode 2*b*.

When the charging bias $V_C$ is applied to the corona wire 2*a* in a state where the grid bias $V_G$ is applied to the grid electrode 2*b*, a corona discharge occurs between the corona wire 2*a* and the photoconductor 1 and negative charge is deposited on the surface of the photoconductor 1. The charging potential $V_D$ of the surface has a value close to that of the grid bias $V_G$ applied to the grid electrode 2*b*. The photoconductor 1 is connected to the ground via a resistor 38.

Because a surface layer 1*a* of the photoconductor 1 is worn with time by sliding contact with the doctor blade or the like, the thickness of the surface layer 1*a* gradually decreases. The capacitance, denoted by C, of the photoconductor 1 is given by the following equation: $C=\in\upsilon\times\in\times S/d$, where $\in\upsilon$ is the permittivity of vacuum, $\in$ is a permittivity of the photoconductor 1, d is the thickness of the surface layer 1*a*, and S is an area of the circumferential surface of the photoconductor 1.

The quantity of electric charge, denoted by Q, of the charged photoconductor 1 is given by the following equation: $Q=C\times V_D=i\times t$, where $V_D$ is the charging potential of the background portion of the photoconductor 1, i is the electric current flowing from the charger unit 2 to the photoconductor 1, and t is charging time, which is equal to passage time over which the surface of the photoconductor 1 passes the facing position where the surface faces the charger unit 2. The following equation is derived from the equations: $V_D=i\times t/C=(i\times t\times d)/(\in\upsilon\times\in\times S)$. Each of the electric constant $\in\upsilon$, $\in$, the dielectric constant of the photoconductor 1, the area S, and the charging time t of this equation is fixed. Accordingly, by defining a coefficient as k (which is a constant), the equation can be expressed as: $V=k\times i\times d$. As can be seen from this equation, the charging potential $V_D$ is proportional to the electric current i and the thickness d. Therefore, in a condition where the charging-current setpoint value $A_{CS}$ for the constant current control of the charging bias $V_C$ and the grid setpoint value $V_{GS}$ for the constant voltage control of the grid bias $V_G$ are maintained constant, the charging potential $V_D$ undesirably drops when the thickness d of the surface layer 1*a* decreases.

To overcome this disadvantage, the image forming apparatus disclosed in Japanese Laid-open Patent Application No. H4-163565 is configured to lessen the drop in the charging potential $V_D$ resulting from the decrease in the thickness d by performing the following process. More specifically, the image forming apparatus includes an ammeter which detects the electric current flowing from a charger unit to the photoconductor. The ammeter may be arranged at a position corresponding to the resistor 38 in FIG. 3, for example. A decrease in the electric current detected by the ammeter indicates that the charging potential $V_D$ has dropped. Therefore, when a decrease in the electric current is detected, the grid bias $V_G$ is preferably increased by increasing the grid setpoint value $V_{GS}$ depending on the amount of the decrease. The charging potential $V_D$ has a value close to that of the grid bias $V_G$ applied to the grid electrode. Accordingly, a drop in the charging potential $V_D$ resulting from a decrease in the thickness d can be lessened by increasing the grid setpoint value $V_{GS}$. Hereinafter, a process of determining the grid setpoint value $V_{GS}$ as required is referred to as "the grid determining process".

Figure 4:
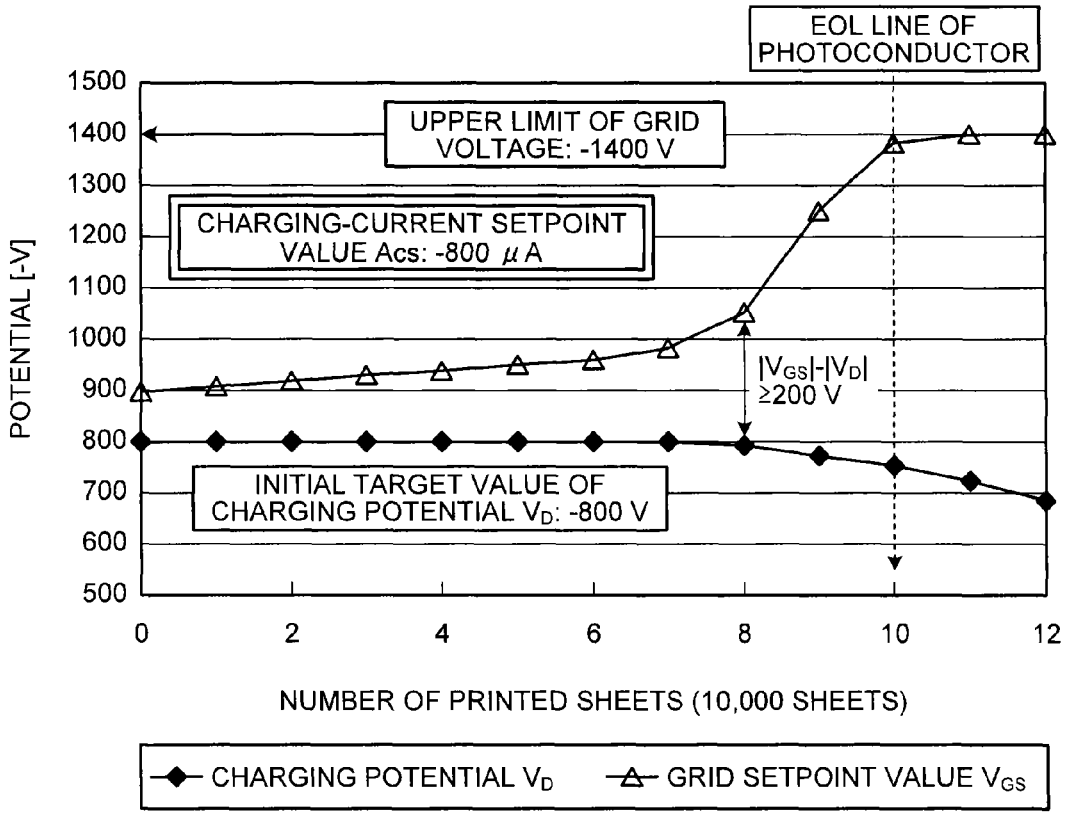
FIG. 4 is a graph illustrating an example of how a charging potential $V_D$ and a grid setpoint value $V_{GS}$ change with time when a grid determining process is performed with a charging-current setpoint value $A_{CS}$ set to −800 μA.

FIG. 4 is a graph illustrating an example of how the charging potential $V_D$ and the grid setpoint value $V_{GS}$ change with time when the grid determining process is performed with the charging-current setpoint value $A_{CS}$ set to −800 μA. Cumulative number of printed sheets is plotted along the horizontal axis of the graph. As the number of printed sheets increases, the surface layer 1*a* of the photoconductor 1 is worn, and the thickness d decreases. If the grid determining process is not performed, the charging potential $V_D$ gradually drops as the number of printed sheets increases. However, if the grid determining process is performed, the drop in the charging potential $V_D$ can be lessened as illustrated in FIG. 4. This is because a decrease in charging performance caused by the decrease in the thickness d is compensated by the increase in the grid bias $V_G$. However, even if the grid determining process is performed, the charging potential $V_D$ gradually drops after the number of printed sheets exceeds 70,000. In this example, it is assumed that the photoconductor is to be replaced when 100,000 sheets have been printed at which the photoconductor is assumed to reach the end of its usable life (hereinafter, "EOL"). For this reason, it is desired to maintain the charging potential $V_D$ at −800 V, which is a target value, until 100,000 sheets have been printed. However, after the number of printed sheets exceeds 70,000, the target charging potential $V_D$ cannot be attained even if the grid setpoint value $V_{GS}$ is increased to −1,400 V, which is an upper limit.

Figure 5:
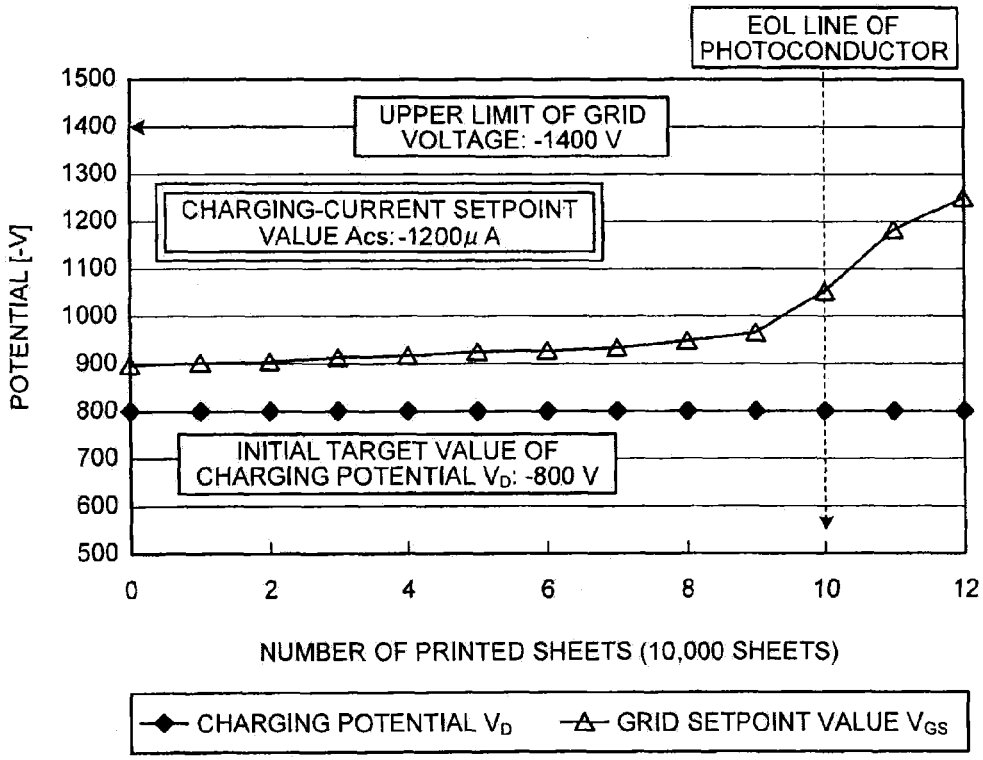
FIG. 5 is a graph illustrating an example of how the charging potential $V_D$ and the grid setpoint value $V_{GS}$ change with time when the grid determining process is performed with the charging-current setpoint value $A_{CS}$ set to −1,200 μA.

FIG. 5 is a graph illustrating an example of how the charging potential $V_D$ and the grid setpoint value $V_{GS}$ change with time when the grid determining process is performed with the charging-current setpoint value $A_{CS}$ set to −1,200 μA. With the charging-current setpoint value $A_{CS}$ increased to −1,200 μA, the charging potential $V_D$ can be maintained at −800 V, which is the target value, until the EOL or, in other words, until 100,000 sheets have been printed, as illustrated in FIG. 5. For this reason, in the conventional image forming apparatus, the charging-current setpoint value $A_{CS}$ is set to a relatively large value so that the target charging potential $V_D$ can be attained even with a photoconductor which has reached the EOL.

However, with the charging-current setpoint value $A_{CS}$ set to such a value, although the target charging potential $V_D$ can be obtained until, for example, 700,000 sheets have been printed with a charging current of −800 μA, the charging current of −1,200 μA is fed. Accordingly, the amount of ozone unnecessarily generated by corona discharge undesirably increases. Because the need for a filter and an exhaust fan to alleviate the discomfort of ozone odor and prevent a health problem arises, cost of the apparatus increases and running cost increases due to waste of energy.

Under the circumstances, the image forming apparatus disclosed in Japanese Laid-open Patent Application No. 2010-181737 is configured to increase the charging-current setpoint value $A_{CS}$ as the physical quantity, such as the cumulative number of revolutions of the photoconductor, which is proportional to the degree of degradation of the photoconductor, increases, thereby reducing waste of energy and generation of ozone.

However, such a configuration undesirably requires that a service person should reset the physical quantity (e.g., the cumulative number of revolutions of the photoconductor) stored in the main control unit to zero each time the photoconductor is replaced. Requiring this resetting operation for each replacement undesirably reduces serviceability considerably. Furthermore, if the service person should forget to reset the physical quantity, the charging bias cannot be controlled properly.

Occurrence of the problem described above is avoidable by employing a configuration in which the charging device includes a sensor for detecting the thickness of the surface layer of the photoconductor, and the charging-current setpoint value $A_{CS}$ is adjusted based on a detection result. However, a contact-type sensor which detects the thickness of the surface layer by contacting the surface layer inevitably causes a damage or wear by contact. Accordingly, such a sensor cannot be used in detecting the thickness of the surface layer of the photoconductor rotating at a high speed stably over a long period of time. For this reason, the need of employing an expensive non-contact-type sensor arises, but it is substantially impracticable to add such a sensor to the apparatus.

Furthermore, the image forming apparatus disclosed in Japanese Laid-open Patent Application No. 2010-181737 is disadvantageously prone to insufficient image density and background fog in a low-temperature and low-humidity environment.

Figure 6:
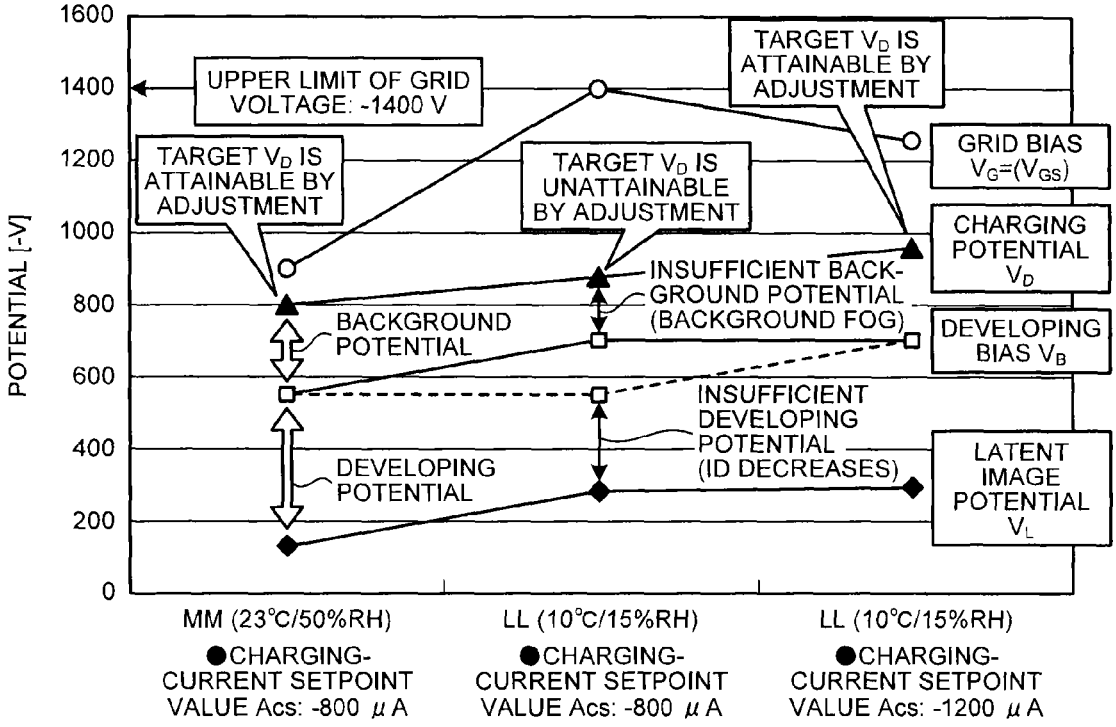
FIG. 6 is a graph illustrating relationship between environment and various potentials at a certain value of a timing parameter (cumulative number of printed sheets)

FIG. 6 is a graph illustrating relationship between environment and various potentials at a certain value of a timing parameter (the cumulative number of printed sheets). In the example illustrated in FIG. 6, the target charging potential $V_D$ of −800 V is successfully obtained at the value of the timing parameter in an MM (medium-temperature and medium-humidity) (23° C. and 50% RH) environment with the charging-current setpoint value $A_{CS}$ set to −800 μA. At this time, the developing potential, which is the difference between a developing bias $V_B$ applied to the developing roller and the latent image potential $V_L$ of the photoconductor, has an appropriate value. Accordingly, the electrostatic latent image is developed in an appropriate density. In addition, the background potential, which is the difference between the developing bias $V_B$ and the charging potential $V_D$, also has an appropriate value. Accordingly, occurrence of background fog is reduced appropriately. Meanwhile, "background fog" is a phenomenon that toner undesirably adheres to a background portion of a photoconductor.

A photoconductor used in an electrophotographic image forming apparatus is generally what is referred to as a separated-function-type layered photoconductor produced by forming a charge generation layer directly on a conductive substrate or with an intermediate layer therebetween and arranging a charge transport layer on the charge generation layer. A surface protection layer may be formed as required on an outermost surface of the photoconductor to improve mechanical or chemical durability. When charge is deposited on such a photoconductor and thereafter optical writing is performed on the photoconductor, light transmits through the charge transport layer and is absorbed by a charge generation material in the charge generation layer. The charge generation material absorbs the light and generates charge carriers. The generated charge carriers are injected into the charge transport layer where the charge carriers move through the charge transport layer along the electric field produced by the charge, thereby neutralizing the surface charge of the photoconductor. As a result, an electrostatic latent image is formed on the surface of the photoconductor. The latent image potential $V_L$ of the photoconductor in an LL environment is higher than in an MM environment. A conceivable cause for this is that the resistance of a photoconductive layer of the photoconductor is increased by influence of the absolute humidity, making it less easy to transport charge carriers and generate the charge carriers in the photoconductive layer and to neutralize an exposed portion of the surface of the photoconductor by the charge injection than in a normal environment.

It is assumed that the output voltage of the developing bias $V_B$ is controlled constant independently of an environment as indicated by a dashed line in FIG. 6. With the charging-current setpoint value $A_{CS}$ set to −800 μA, the latent image potential $V_L$ in the LL (10° C. and 15% RH) environment is higher than that in the MM environment. Accordingly, the developing potential in the LL environment is lower than in the MM environment. This undesirably leads to insufficient image density ID.

Meanwhile, conventionally, image forming apparatuses employ a configuration in which the following process is performed at regular intervals so that stable image density can be attained independently of an environment. More specifically, a pattern image for image-density detection is formed. The developing bias $V_B$ is adjusted based on a result of detecting an amount of toner (image density) deposited to form the pattern image, thereby maintaining the developing potential appropriately. In this process, the developing bias $V_B$ is increased higher than in the MM environment as the latent image potential $V_L$ in the LL environment increases as indicated by a solid line (with the charging current of −800 μA) representing the developing bias $V_B$ in FIG. 6. Performing such control allows maintaining the developing potential appropriately. However, this control disadvantageously makes background fog more likely to occur. This is because the background potential is decreased by the increase in the developing bias $V_B$.

Hence, in the LL environment, it is desirable to deposit charge on the photoconductor with the charging potential $V_D$ higher than −800 V. More specifically, it is desirable to increase the charging potential $V_D$ larger (in the negative sense, it is same in the rest) than −800 V by the degree corresponding to an increase in the latent image potential $V_L$ which is increased by a change in environment to the LL environment. To attain this, it is required to set the charging-current setpoint value $A_{CS}$ in the LL environment to a value (−1,200 μA in the example illustrated in FIG. 6) larger than that (−800 μA in the example illustrated in FIG. 6) in the MM environment. However, such a configuration as that employed by the image forming apparatus disclosed in Japanese Laid-open Patent Application No. 2010-181737 which adjusts the charging-current setpoint value $A_{CS}$ based on a physical quantity having correlation to the wear amount of the surface layer of the photoconductor cannot set the charging-current setpoint value $A_{CS}$ appropriately depending on the environment. If the charging-current setpoint value $A_{CS}$ is set for an MM environment, insufficient image density or background fog can undesirably occur in an LL environment as described earlier. If the charging-current setpoint value $A_{CS}$ is set for an LL environment, the charging potential $V_D$ becomes excessively high in an MM environment. As a result, the developing potential is increased excessively, undesirably resulting in bead carry over.

It is possible to avoid background fog, insufficient image density, bead carry over, and the like by, when a target value of the charging potential $V_D$ becomes unattainable, displaying an error indication and forcibly terminating the apparatus. However, making the apparatus unusable will cause considerably inconvenience to a user.

Feature configuration of the printer according to the embodiment is described below.

As the charging performance of the photoconductor 1 decreases with the decrease in the thickness d of the surface layer 1*a* of the photoconductor 1, the charging potential $V_D$ decreases to a value below a target value. However, when the thickness d has not decreased severely yet, the charging potential $V_D$ can be increased to the target value by increasing the grid setpoint value $V_{GS}$ without increasing the charging-current setpoint value $A_{CS}$. Even if a cause of a drop in the charging potential $V_D$ is a change in environment to an LL environment, so long as the thickness d has not decreased severely yet, the charging potential $V_D$ can be increased to the target value only by increasing the grid setpoint value $V_{GS}$ without increasing the charging-current setpoint value $A_{CS}$. The increasing amount of the grid setpoint value $V_{GS}$ is preferably determined depending on the difference between the target value of the charging potential $V_D$ and an actual value.

Hence, the main control unit 100 described above is configured to perform, in the grid determining process, a process of determining the grid setpoint value $V_{GS}$ based on the difference between the target value of the charging potential $V_D$ and the detection result output from the surface potential sensor 3.

In contrast, in a case where the thickness d has decreased severely and the decrease in the thickness d and/or a change in environment to an LL environment has made the target charging potential $V_D$ unattainable, the target charging potential $V_D$ cannot be obtained only by increasing the grid setpoint value $V_{GS}$. If the charging potential $V_D$ is far below the target value even though the grid setpoint value $V_{GS}$ is set to a larger value, the severe decrease in the thickness d requires that the charging-current setpoint value $A_{CS}$ be increased.

Hence, the main control unit 100 described above is configured to perform not only the grid determining process but also a charging-current determining process which determines the charging-current setpoint value $A_{CS}$ based on a difference between an actual value (detection result) of the charging potential $V_D$ and the grid setpoint value $V_{GS}$.

Figure 7:
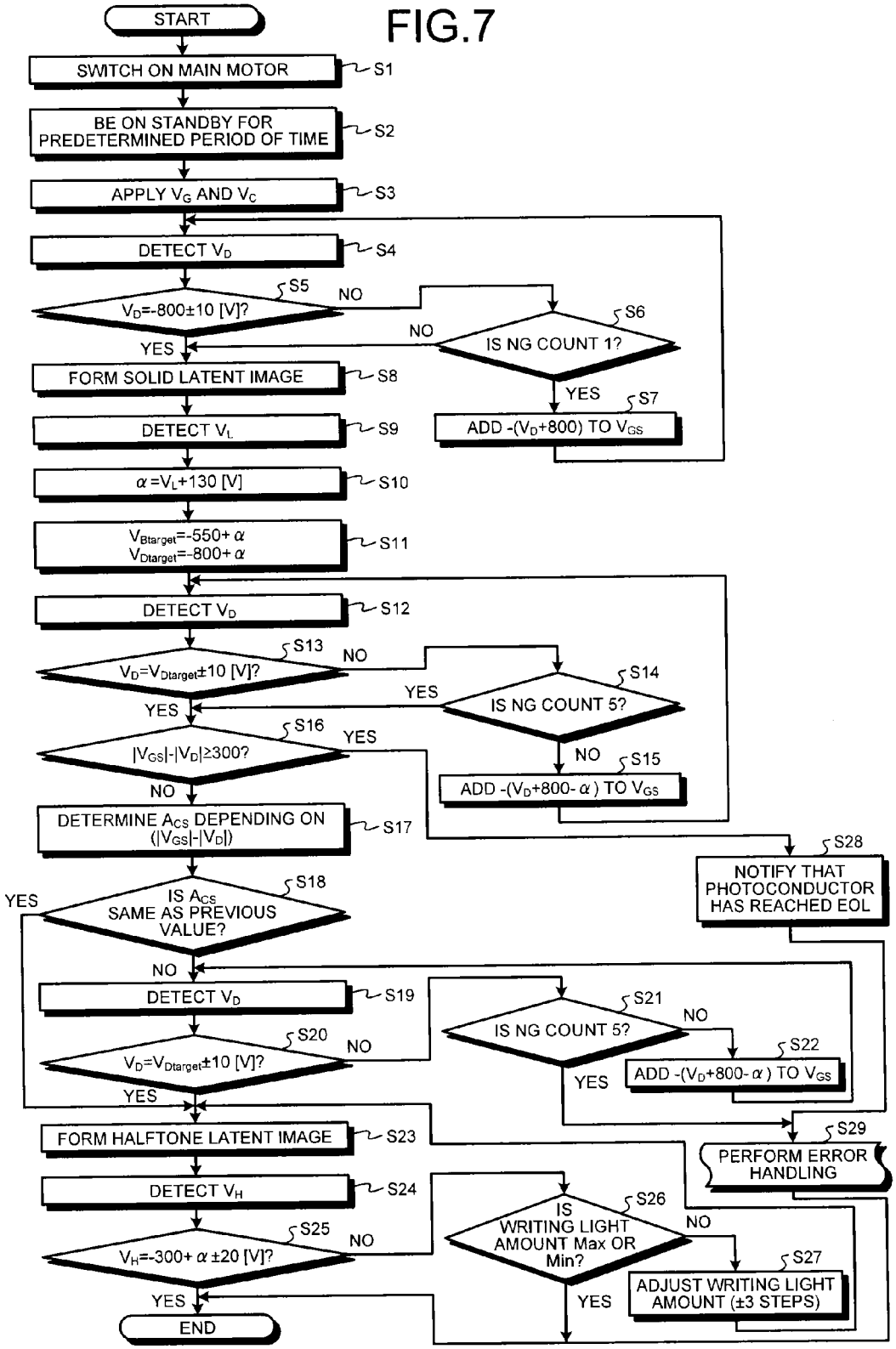
FIG. 7 is a flowchart illustrating a control flow of a periodic routine performed at regular intervals by a main control unit of the printer.

FIG. 7 is a flowchart illustrating a control flow of a periodic routine performed at regular intervals by the main control unit 100. The periodic routine is performed at regular intervals, such as at each lapse of a predetermined period of time or every predetermined number of sheets. If a consecutive print job, which consecutively outputs images on multiple recording sheets, is being performed at an instant when the periodic routine is to be performed, the consecutive print job is interrupted and the periodic routine is performed.

At start of the periodic routine, the main control unit 100 starts driving a main motor first (Step 1; hereinafter, Step is abbreviated as "S") and thereafter is on standby for a predetermined period of time (S2). The main control unit 100 causes the charging bias $V_C$ to be applied to the corona wire 2*a* while causing the grid bias $V_G$ to be applied to the grid electrode 2*b* of the charger unit 2 with the photoconductor 1 driven to rotate, thereby depositing charge uniformly on the surface of the photoconductor 1 (S3). At this step, values determined in an immediately preceding cycle of the periodic routine are used as the grid setpoint value $V_{GS}$, which is the setpoint value for the constant voltage control of the grid bias $V_G$, and the charging-current setpoint value $A_{CS}$, which is the setpoint value for the constant current control of the charging bias $V_C$.

After starting the charging process of the photoconductor 1, at an instant when the charged surface of the photoconductor 1 is advanced to the facing position where the surface faces the surface potential sensor 3, the main control unit 100 obtains a result of detecting the charging potential $V_D$ output from the surface potential sensor 3 (S4). In the printer of the embodiment, a target charge value $V_{Dtarget}$, which is the target value of the charging potential $V_D$, is −800 V in principle but can be larger or smaller than −800 V depending on environmental variation. The main control unit 100 assumes a condition where the target charge value $V_{Dtarget}$ is set to −800 V at first, and determines whether or not the obtained charging potential $V_D$ falls within a range between −790 V and −810 V (S5). If the charging potential $V_D$ falls out of a range between −790 V and −810 V, the excessively-high or excessively-low charging potential $V_D$ can cause a variety of problem. Accordingly, if the charging potential $V_D$ falls out of the range (No at S5), the main control unit 100 determines whether or not an NG count, which is the number of times when the charging potential $V_D$ is determined to be out of the range at S5 (the number of times since the start of the periodic routine), is one (S6). If the NG count is one (Yes at S6), the main control unit 100 updates the grid setpoint value $V_{GS}$ by adding $-(V_D+800)$ to the grid setpoint value $V_{GS}$ (S7), and thereafter loops the control flow back to S4 to re-detect the charging potential $V_D$ in a condition of the updated grid setpoint value $V_{GS}$. If the thickness d of the surface layer 1*a* of the photoconductor 1 has not decreased severely yet, the charging potential $V_D$ detected at this time should fall within the range between −790 V and −810 V. However, if the thickness d has decreased severely, the charging potential $V_D$ can go out of the range. Even if the charging potential $V_D$ goes out of the range, there can be a situation where the charging potential $V_D$ can be brought into the range by further increasing the charging-current setpoint value $A_{CS}$. There can also be a situation where it is desired to increase the charging potential $V_D$ larger than −810 V when the latent image potential $V_L$ is increased larger than −130 V, which is a target value, by a change in environment to an LL environment. Accordingly, if the NG count is not one (No at S6), the main control unit 100 proceeds the control flow to S8 and subsequent steps without re-correcting the grid setpoint value $V_{GS}$. Also when the charging potential $V_D$ has fallen within the range between −790 V and −810 V (Yes at S5), the main control unit 100 proceeds the control flow to S8 and subsequent steps.

At S8 and subsequent steps, a solid latent image is formed on the surface of the photoconductor 1 by performing optical writing on the photoconductor 1 (S8). The solid latent image is formed in a region, which is a part of the whole area of the surface of photoconductor 1 and larger in area than an area to be detected by the surface potential sensor 3. The region passes the facing position where the region faces the surface potential sensor 3. At an instant when the solid latent image is advanced to the facing position where the solid latent image faces the surface potential sensor 3, the main control unit 100 obtains a detection result output from the surface potential sensor 3 and sets the obtained result as the latent image potential $V_L$ (S9). The main control unit 100 calculates α, which is a potential correction value, from the following equation: $\alpha=V_L+130$ (V) (S10). The potential correction value α is for correcting the target charge value $V_{Dtarget}$ and a target developing bias value $V_{Btarget}$ by compensating for the difference between the actual latent image potential $V_L$ and the target value of the latent image potential $V_L$. This correction allows, even when the latent image potential $V_L$ deviates from its target value −130 V, correcting both the background potential and the developing potential to their target values. For this reason, the main control unit 100 corrects the developing-bias target value $V_{Btarget}$ which is an output setpoint value for the constant voltage control of the developing bias $V_B$, to a solution of the following equation: $V_{Btarget}=-550+\alpha$. Similarly, the main control unit 100 corrects the target charge value $V_{Dtarget}$ to a solution of the following equation: $V_{Dtarget}=-800+\alpha$ (S11).

Thereafter, the main control unit 100 determines whether or not the target charge value $V_{Dtarget}$ can be obtained with a value of the grid setpoint value $V_{GS}$ in the current state (hereinafter, "current value of the grid setpoint value $V_{GS}$) and a current value of the charging-current setpoint value $A_{CS}$. More specifically, the main control unit 100 causes charge to be deposited on the photoconductor 1 with the current value of the grid setpoint value $V_{GS}$ and the current value of the charging-current setpoint value $A_{CS}$. Thereafter, at an instant when a charged portion of the photoconductor 1 is advanced to the facing position where the charged portion faces the surface potential sensor 3, the main control unit 100 obtains a detection result output from the surface potential sensor 3 and sets the obtained result as the charging potential $V_D$ (S12). The main control unit 100 determines whether or not the obtained charging potential $V_D$ falls within a range between ((the target charge value $V_{Dtarget}$)−10) V and ((the target charge value $V_{Dtarget}$)+10) V (S13). If the charging potential $V_D$ falls out of the range (No at S13), the main control unit 100 determines whether or not an NG count, which is the number of times when the charging potential $V_D$ is determined to be out of the range at S13, is five (S14). If the NG count is not five (No at S14), the main control unit 100 corrects the grid setpoint value $V_{GS}$ by adding $-(V_D+800-\alpha)$ to the grid setpoint value $V_{GS}$ (S15). Thereafter, the main control unit 100 causes charge to be deposited on the photoconductor 1 with the corrected grid setpoint value $V_{GS}$ and loops the control flow back to S12. As a result, the charging potential $V_D$ is detected again and, if necessary, the grid setpoint value $V_{GS}$ is re-corrected.

Assume that the obtained charging potential $V_D$ cannot be brought into the range between ((the target charge value $V_{Dtarget}$)−10) V and ((the target charge value $V_{Dtarget}$)+10) V even though the grid setpoint value $V_{GS}$ is repeatedly corrected. In this case, the target charge value $V_{Dtarget}$ is unattainable only by correcting the grid setpoint value $V_{GS}$. In the printer according to the embodiment, it is assumed that the photoconductor 1 has reached the EOL when the number of printed sheets has reached 100,000. It is also assumed that, if the charging-current setpoint value $A_{CS}$ is unchanged from its initial value, or −800 μA, until the photoconductor 1 reaches the EOL, the potential changes with time as in the example illustrated in FIG. 4. Referring to FIG. 4, the grid setpoint value $V_{GS}$ starts sharply rising approximately when the number of printed sheets has reached 70,000, and the difference between the grid setpoint value $V_{GS}$ and the charging potential $V_D$ gradually increases with the rise in the grid setpoint value $V_{GS}$. Approximately when the number of printed sheets reaches 80,000, the difference becomes 200 V or larger. At this point in time, the photoconductor 1 has not reached the EOL yet. However, unless the grid setpoint value $V_{GS}$ is increased to approximately −1,000 V, the target charging potential $V_{Dtarget}$ cannot be obtained. However, because the value, to which the grid setpoint value $V_{GS}$ is increased, is lower than its upper limit value (−1,400 V), the target charging potential $V_{Dtarget}$ is still attainable only by changing the grid setpoint value $V_{GS}$.

As the photoconductor approaches the EOL, it becomes more and more difficult to deposit charge on the photoconductor 1 to the target charging potential $V_{Dtarget}$ only by adjusting the grid setpoint value $V_{GS}$. As a result, a charging-current switching value, which is calculated as the difference ($|V_{GS}|-|V_D|$), increases. However, the target charging potential $V_{Dtarget}$ is attainable even when the photoconductor is near the EOL by adopting the following scheme. That is, a threshold of the charging-current switching value ($|V_{GS}|-|V_D|$) is determined in advance. The charging-current setpoint value $A_{CS}$ is increased at a point in time when the charging-current switching value reaches the threshold.

Thus, the main control unit 100 repeats correcting the grid setpoint value $V_{GS}$ as required until the NG count is equal to or smaller than four, thereby causing the charging potential $V_D$ to approach the target charge value $V_{Dtarget}$. However, when the NG count has increased to five (Yes at S14), the target charge value $V_{Dtarget}$ cannot be obtained only by changing the grid setpoint value $V_{GS}$. In this case, the main control unit 100 proceeds the control flow to S16 and subsequent steps without further correcting the grid setpoint value $V_{GS}$. Also when the charging potential $V_D$ has fallen within the range (Yes at S13), the main control unit 100 proceeds the control flow to S16 and subsequent steps.

Figure 8:
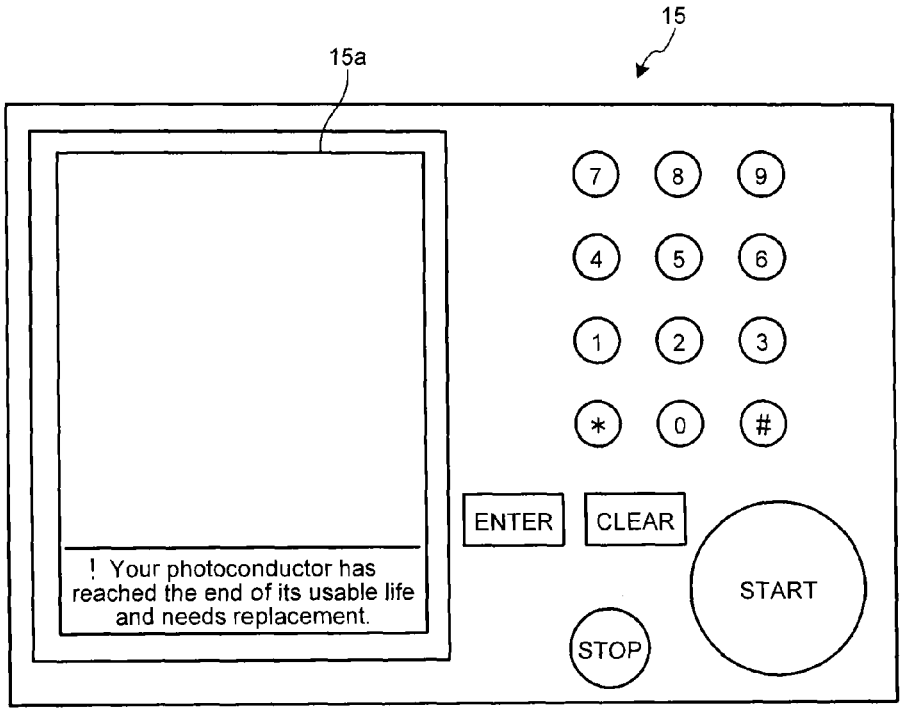
FIG. 8 is an enlarged plane view illustrating an operating/display unit of the printer.

The main control unit 100 then calculates the charging-current switching value, which is the solution of ($|V_{GS}|-|V_D|$). For example, if the grid setpoint value $V_{GS}$ is −1,100 V and the charging potential $V_D$ is −850 V, the main control unit 100 calculates the charging-current switching value as |1,100|−|850|=250. In a state where the thickness d has decreased further than the EOL, even if the grid setpoint value $V_{GS}$ is increased to a value close to its upper limit, the charging potential $V_D$ is far below the target charge value $V_{Dtarget}$, making the charging-current switching value ($|V_{GS}|-|V_D|$) considerably large. The main control unit 100 determines whether or not the calculated charging-current switching value is equal to or larger than 300 (S16). If the charging-current switching value is equal to or larger than 300 (Yes at S16), the main control unit 100 determines that the photoconductor 1 has reached the EOL, and notifies a user that the photoconductor 1 has reached the EOL (S28). Thereafter, the main control unit 100 forcibly terminates the apparatus by performing error handling (S29), and ends the sequence of the control flow. Notification to a user may be provided by, for example, displaying a text such as "Your photoconductor has reached the end of its usable life and needs replacement." indicating that the photoconductor has reached the EOL on a display 15*a* of the operating/display unit 15 as illustrated in FIG. 8.

If the charging-current switching value is smaller than 300 (No at S16), the main control unit 100 sets the charging-current setpoint value $A_{CS}$ depending on the charging-current switching value (S17). More specifically, because the grid setpoint value $V_{GS}$ has been repeatedly corrected at steps prior to S17 as required, if the thickness d of the surface layer 1*a* of the photoconductor 1 has not decreased severely yet, the charging potential $V_D$ will be close to the target charge value $V_{Dtarget}$. On the other hand, if the thickness d has decreased severely, the charging potential $V_D$ will be smaller than the target charge value $V_{Dtarget}$, making the charging-current switching value, which is the difference between the grid setpoint value $V_{GS}$ and the charging potential $V_D$, considerably large. However, if the thickness d has not decreased to the EOL of the photoconductor 1 yet, the charging potential $V_D$ can be increased to the target charge value $V_{Dtarget}$ by further increasing the grid setpoint value $V_{GS}$. Hence, the main control unit 100 sets the charging-current setpoint value $A_{CS}$ according to the data table given below as TABLE 1 (S17).

TABLE 1

| Charging-Current Switching Value ($\|V_{GS}\| - \|V_D\|$) | Charging-Current Setpoint Value $A_{CS}$ (−μA) |
|---|---|
| ($\|V_{GS}\| - \|V_D\|$) < 200 | 800 |
| ($\|V_{GS}\| - \|V_D\|$) ≥ 200 | 1,200 |

As presented in TABLE 1, if the charging-current switching value is smaller than 200, the charging-current setpoint value $A_{CS}$ is set to −800 μA. This corresponds to a case where the target charge value $V_{Dtarget}$ is attainable only by correcting the grid setpoint value $V_{GS}$. On the other hand, if the charging-current switching value is equal to or higher than 200, the charging-current setpoint value $A_{CS}$ is set to −1,200 μA. This corresponds to a case where the target charge value $V_{Dtarget}$ is unattainable only by correcting the grid setpoint value $V_{GS}$. Although not shown in TABLE 1, if the charging-current setpoint value $A_{CS}$ determined by the charging-current determining process (S17) is different from its previous value, the grid setpoint value $V_{GS}$ is returned to its initial value, or −900 V.

Assume that the charging-current setpoint value $A_{CS}$ determined by the charging-current determining process (S17) is the same as its previous value. Put another way, assume that the charging-current setpoint value $A_{CS}$ is not changed by the process at S17. In this case, the grid setpoint value $V_{GS}$ has already been adjusted to a value suitable for the charging-current setpoint value $A_{CS}$ by the process at S7 or S15 described above. On the other hand, if the charging-current setpoint value $A_{CS}$ is changed (updated) from its previous value by the charging-current determining process (S17), the current value of the grid setpoint value $V_{GS}$ may be unsuitable for the updated charging-current setpoint value $A_{CS}$.

Hence, the main control unit 100 determines, after the process at S17, whether or not the charging-current setpoint value $A_{CS}$ is the same as its previous value (S18). If the charging-current setpoint value $A_{CS}$ is not the same as its previous value (No at S18), the main control unit 100 adjusts the grid setpoint value $V_{GS}$ by performing the process from S19 to S22. More specifically, the main control unit 100 causes charge to be deposited on the photoconductor 1 with a current value of the grid setpoint value $V_{GS}$ and a current value of the charging-current setpoint value $A_{CS}$. At an instant when a charged portion of the photoconductor 1 is advanced to the facing position where the charged portion faces the surface potential sensor 3, the main control unit 100 obtains a detection result output from the surface potential sensor 3 and sets the obtained result as the charging potential $V_D$ (S19). Thereafter, the main control unit 100 determines whether or not the obtained charging potential $V_D$ falls within the range between ((the target charge value $V_{Dtarget}$)−10) V and ((the target charge value $V_{Dtarget}$)+10) V (S20). If the charging potential $V_D$ falls out of the range (No at S20), the main control unit 100 determines whether or not an NG count (which is a cumulative NG count counted since the charging-current setpoint value $A_{CS}$ is updated) is five (S21). If the NG count is not five (No at S21), the main control unit 100 corrects the grid setpoint value $V_{GS}$ by adding $-(V_D+800-\alpha)$ to the grid setpoint value $V_{GS}$ (S22). Thereafter, the main control unit 100 loops the control flow back to S19, thereby causing charge to be deposited on the photoconductor 1 with the corrected grid setpoint value $V_{GS}$ and, if necessary, further correcting the grid setpoint value $V_{GS}$. On the other hand, if the NG count is five (Yes at S21), the main control unit 100 forcibly terminates the apparatus by performing error handling (S29), and thereafter ends the sequence of the control flow.

Note that, if the charging-current setpoint value $A_{CS}$ is increased in a state where the thickness d has not decreased close to the EOL of the photoconductor 1 yet, the charging potential $V_D$ can attain the target charge value $V_{Dtarget}$ even with an initial value of the grid setpoint value $V_{GS}$. Thereafter, as the thickness d decreases, the charging potential $V_D$ will gradually drop. However, in some cases, the charging potential $V_D$ can be increased to the target charge value $V_{Dtarget}$ by increasing the grid setpoint value $V_{GS}$.

If it is determined that the charging potential $V_D$ falls within the range (Yes at S20), optical writing is performed on the charged photoconductor 1 to form a halftone latent image (S23). The halftone latent image is an electrostatic latent image expressed by varying area coverage levels using dithering or the like and formed on the same surface region as the solid latent image described above. The halftone latent image is substantially equal to the solid latent image in area. At an instant when the halftone latent image is advanced to the facing position where the halftone latent image faces the surface potential sensor 3, the main control unit 100 obtains a detection result output from the surface potential sensor 3 and sets the obtained result as a halftone potential $V_H$ (S24). The main control unit 100 determines whether or not the halftone potential $V_H$ falls within a range between $(-300+\alpha+20)$ V and $(-300+\alpha-20)$ V (S25). If the halftone potential $V_H$ falls within the range (Yes at S25), the main control unit 100 ends the sequence of the control flow. On the other hand, if the halftone potential $V_H$ falls out of the range (No at S25), the main control unit 100 determines whether or not an amount of writing light per dot (hereinafter, "writing light amount") is set to its maximum value or minimum value (S26). If the writing light amount is set to its maximum value or the minimum value (Yes at S26), the main control unit 100 ends the sequence of the control flow. On the other hand, if the writing light amount is set to neither the its maximum value nor the minimum value (No at S26), the main control unit 100 corrects the writing light amount by decreasing (if the writing light amount is higher than the maximum value) or increasing (if the writing light amount is lower than the minimum value) the writing light amount three levels (S27). Thereafter, the main control unit 100 loops the control flow back to S23, thereby forming a halftone latent image and, if necessary, correcting the writing light amount. Correcting the writing light amount in this manner allows adjusting the halftone potential $V_H$ depending on the latent image potential $V_L$ which changes with environmental change, thereby maintaining favorable halftone image reproducibility.

A configuration which, if the charging potential $V_D$ cannot be brought into the above-described range even by correcting the halftone potential $V_H$ a predetermined number of times, error handling is performed to forcibly terminate the apparatus may be employed. If the temperature or the humidity rises after the charging-current setpoint value $A_{CS}$ has been increased from −800 μA to −1,200 μA because of a change in environment an LL environment, the latent image potential $V_L$ drops with the rise in the temperature or the humidity. In this case, the potential correction value α calculated at S10 decreases. As a result, the target charge value $V_{Dtarget}$ calculated at S11 decreases, and the charging-current setpoint value $A_{CS}$ may be returned from −1,200 μA to −800 μA at S16.

In the periodic routine described above, the process at S17 corresponds to the charging-current determining process which determines the charging-current setpoint value $A_{CS}$ based on the difference between the result of detecting the charging potential $V_D$ output from the surface potential sensor 3 and the grid setpoint value $V_{GS}$. Adjusting, by performing the charging-current determining process, the charging current to a value which depends to the decrease in the thickness d and an environment makes it possible to deposit charge on the photoconductor 1 to a potential substantially equal to the target charge value $V_{Dtarget}$ while avoiding generation of unnecessary ozone and waste of energy. Accordingly, the need of adding a filter and an exhaust fan for ozone removable can be eliminated, and undesirable increase in size of the apparatus and cost can be avoided. Furthermore, stable image density can be obtained independently of an environment. Still furthermore, nevertheless the developing bias $V_B$ is corrected to a value which depends on the environment, the background potential can be maintained at an appropriate value and occurrence of background fog can be reduced. Still furthermore, in the present embodiment, in contrast to the image forming apparatus disclosed in Japanese Laid-open Patent Application No. 2010-181737, the process of determining the charging-current setpoint value $A_{CS}$ based on a physical quantity having correlation to the thickness d is not performed. Accordingly, the need for resetting the physical quantity information when replacing the photoconductor is obviated from a service person.

Figure 9:
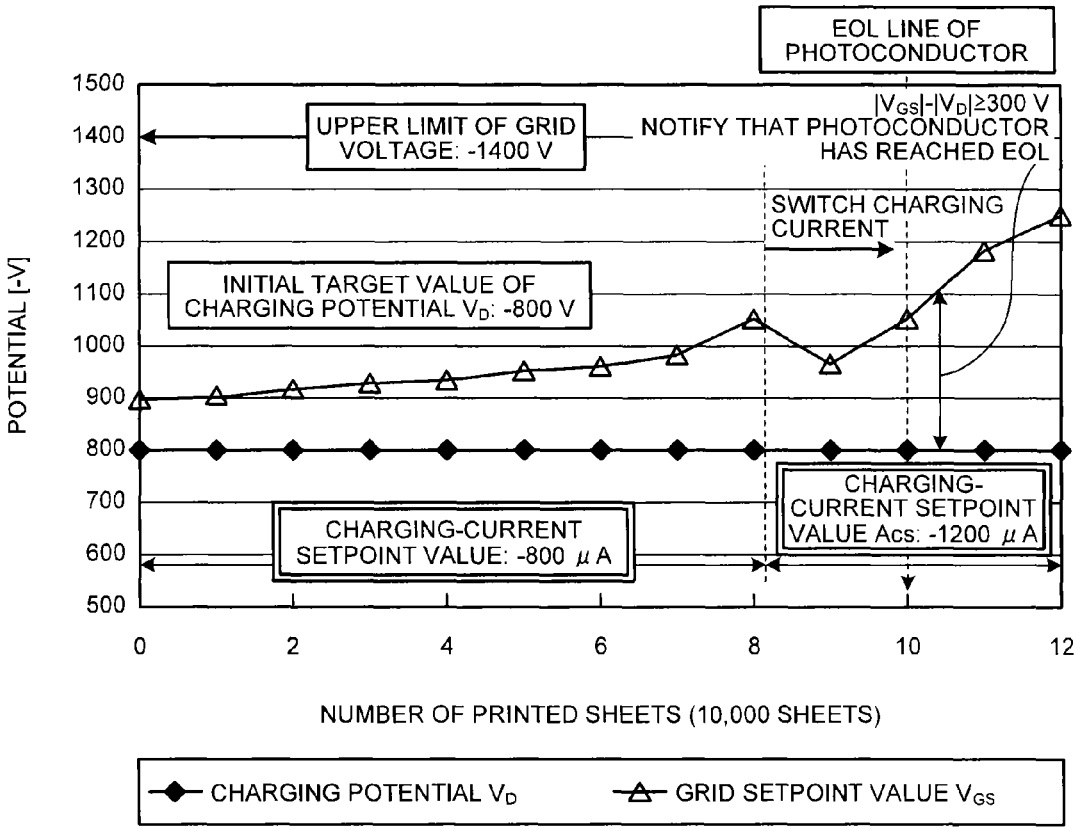
FIG. 9 is a graph illustrating an example of how the charging potential $V_D$ and the grid setpoint value $V_{GS}$ of the printer change with time.

FIG. 9 is a graph illustrating an example of how the charging potential $V_D$ and the grid setpoint value $V_{GS}$ of the printer according to the embodiment change with time. As illustrated in FIG. 9, the grid setpoint value $V_{GS}$ gradually increases with the number of printed sheets from the initial state until when the number of printed sheets reaches 70,000. After the number of printed sheets has exceeded 70,000, the grid setpoint value $V_{GS}$ sharply increases. When the number of printed sheets has exceeded 80,000, the charging-current switching value $(|V_{GS}|-|V_D|)$ exceeds 200. Accordingly, the charging-current setpoint value $A_{CS}$ is switched from −800 μA to −1,200 μA and, simultaneously, the grid setpoint value $V_{GS}$ is returned to its initial value, −900 V. Even if the grid setpoint value $V_{GS}$ is returned to its initial value in this manner, because the charging-current setpoint value $A_{CS}$ is increased, the charging potential $V_D$ is maintained at its target value, −800 V. Thereafter, as the number of printed sheets further increases, the thickness d decreases, and the charging performance of the photoconductor 1 gradually decreases. Accordingly, the grid setpoint value $V_{GS}$ is increased step by step. This increase in the grid setpoint value $V_{GS}$ allows the charging potential $V_D$ to be maintained at the target value, or −800 V, until when the photoconductor 1 reaches the EOL (100,000 sheets). When the photoconductor 1 is used even after exceeding a line of the EOL (hereinafter, "EOL line") (100,000 sheets), the charging-current switching value $(|V_{GS}|-|V_D|)$ increases to a value larger than 300, and a notification that the photoconductor has reached the EOL is provided to a user.

The charging-current switching value does not necessarily have such two-level values as those presented in TABLE 1, and may alternatively have three-or-higher-level values as those presented in, for example, TABLE 2. The values of the different levels may preferably be respectively assigned to corresponding values of the charging-current setpoint value $A_{CS}$.

TABLE 2

| Charging-Current Switching Value (\|VGS\| − \|VD\|) | Charging-Current Setpoint Value ACS (−μA) |
|---|---|
| (\|VGS\| − \|VD\|) < 150 | 800 |
| 150 ≤ (\|VGS\| − \|VD\|) < 200 | 1,000 |
| (\|VGS\| − \|VD\|) ≥ 200 | 1,200 |

A printer according to an implementation example implemented by adding more specific feature configuration to the printer according to the embodiment is described below.

Figure 10:
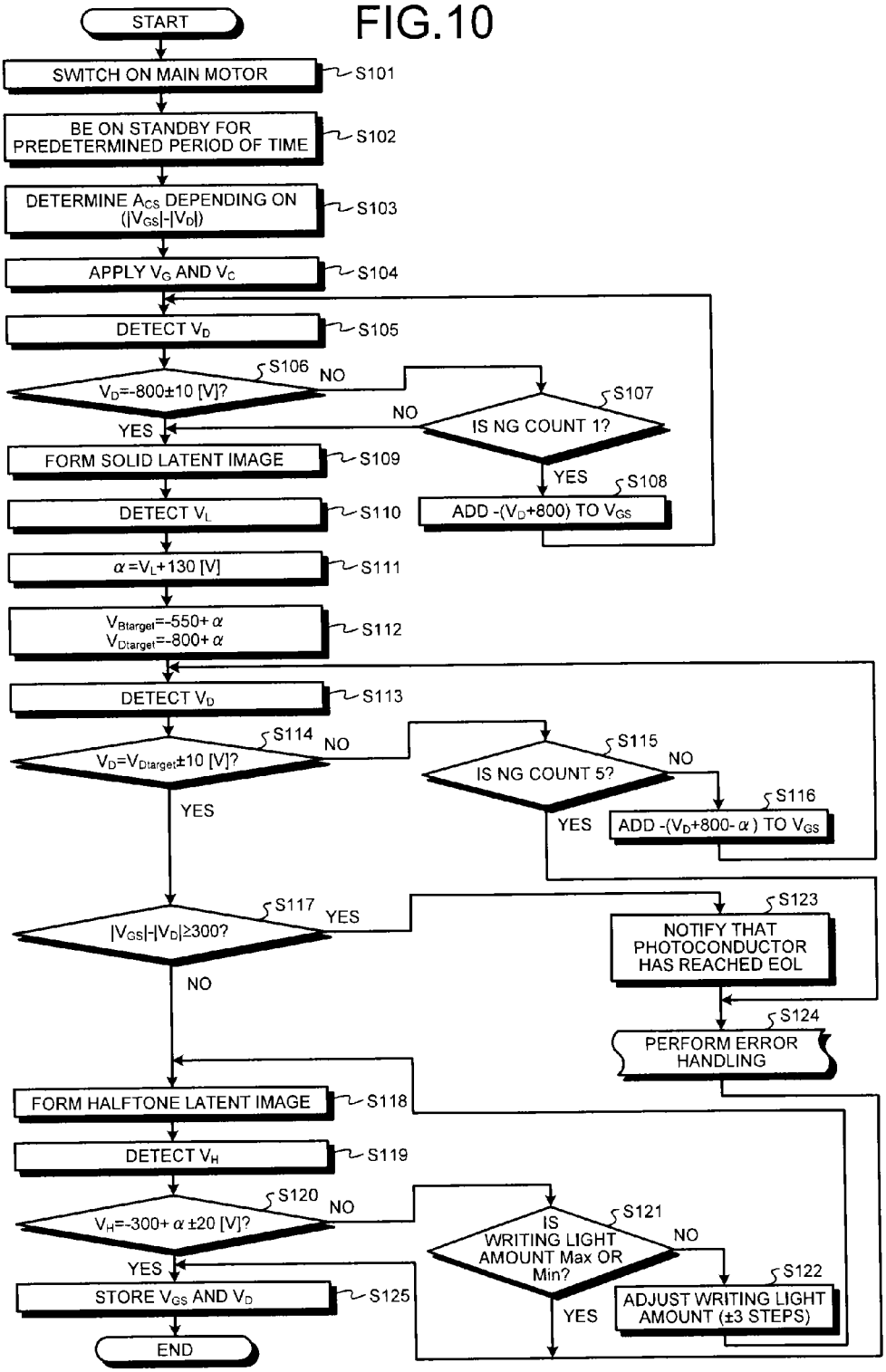
FIG. 10 is a flowchart illustrating a control flow of a periodic routine performed at regular intervals by the main control unit of a printer according to an implementation example.

FIG. 10 is a flowchart illustrating a control flow of a periodic routine performed at regular intervals by the main control unit 100 of the printer according to the implementation example. At start of the periodic routine, the main control unit 100 starts driving the main motor first (S101) and thereafter is on standby for a predetermined period of time (S102). The main control unit 100 sets the charging-current setpoint value $A_{CS}$ based on the charging-current switching value ($|V_{GS}|-|V_D|$) according to the data table given in TABLE 1 or TABLE 2 described above (S103). In short, the main control unit 100 performs the charging-current determining process. At this step, values determined at the last step (S125) of an immediately preceding cycle of the periodic routine are used as the grid setpoint value $V_{GS}$ and the charging potential $V_D$. Thereafter, the control flow proceeds to S104 and subsequent steps.

The process from S104 to S117 is similar to the process from S3 to S16 of the printer according to the embodiment, and repeated description is omitted. The process from S118 to S122 is similar to the process from S23 to S27 of the printer according to the embodiment, and repeated description is omitted.

Immediately before exiting the periodic routine, the main control unit 100 stores a current value of the grid setpoint value $V_{GS}$ and a current value of the charging potential $V_D$ in a non-volatile memory (S125). The stored data is used at S103 and S104 in the next cycle of the periodic routine.

What makes the periodic routine described above particularly different from the periodic routine of the printer according to the embodiment is that the charging-current determining process (S103) is performed earlier than the grid determining process (S108 and S116). By virtue of this difference, the number of times the grid determining process is performed can be reduced.

The difference is described more specifically below. If the charging-current setpoint value $A_{CS}$ is changed (updated) from its previous value by the charging-current determining process, as described earlier, the grid setpoint value $V_{GS}$ is returned to its initial value, −900 V. However, the initial value may be unsuitable for the updated charging-current setpoint value $A_{CS}$. This is because a suitable value varies depending on how much the thickness d has decreased and an environment. For this reason, if the charging-current setpoint value $A_{CS}$ is changed (updated) from its previous value by the charging-current determining process, it is desirable to perform the grid determining process to adjust the grid setpoint value $V_{GS}$ to a value suitable for the updated charging-current setpoint value $A_{CS}$.

With regard to the printer according to the embodiment, the periodic routine of the printer performs the grid determining process at three steps as presented in the flowchart of FIG. 7. The first one of the three steps is S7. The purpose of performing the grid determining process at S7 is to bring the charging potential $V_D$ closer to the target charge value $V_{Dtarget}$ by a certain degree if the difference of the charging potential $V_D$ with respect to the target charge value $V_{Dtarget}$ is large.

The second one of the three steps where the grid determining process is performed is S15. The purpose of performing the grid determining process at S15 is to bring the charging potential $V_D$ closer to the target charge value $V_{Dtarget}$ if the target charge value $V_{Dtarget}$ is changed (updated) to a value suitable for the latent image potential $V_L$ at S11 which is performed after S7.

The third one of the three steps where the grid determining process is performed is S22. The purpose of performing the grid determining process at S22 is to adjust the grid setpoint value $V_{GS}$ to a value suitable for the updated charging-current setpoint value $A_{CS}$, when the charging-current setpoint value $A_{CS}$ is changed (updated) from its previous value by the process at S17.

Any one of the steps where the grid determining process is performed involves the process of depositing charge on the photoconductor 1 to detect the charging potential $V_D$ prior to performing the grid determining process. Accordingly, performing the grid determining process requires a relatively long period of time at each of the steps.

By contrast, in the printer according to the implementation example, the periodic routine of the printer performs the grid determining process only at two steps as presented in the flowchart of FIG. 10. The first one of the two steps where the grid determining process is performed is S108. The second one of the two steps where the grid determining process is performed is S116. The reason why the grid determining process is performed at S108 is the same as the reason why the grid determining process is performed at S7 in the embodiment. By contrast, the reason why the grid determining process is performed at S116 in the implementation example is a combination of the same reason as the reason why the grid determining process is performed at S15 and the same reason as the reason why the grid determining process is performed at S22 in the embodiment. By virtue of this difference, the number of times the grid determining process is performed can be reduced. As a result, time necessary to perform the periodic routine can be shortened, and downtime of the apparatus can be reduced.

The embodiment described above is merely an example. The following aspects of the present invention provide an advantage(s) specific to each of the following aspects A to G.

Aspect A

According to the aspect A of the present invention, a charging device (e.g., the charging device 200) including a discharge electrode (e.g., the corona wire 2*a*) for establishing a discharge, a grid electrode (e.g., the grid electrode 2*b*) arranged between the discharge electrode and a latent-image bearer (e.g., the photoconductor 1) of an image forming apparatus, a charging power supply (e.g., the corona power supply 16) configured to feed, with constant current control, a charging bias to be applied to the discharge electrode to deposit charge on a surface of the latent-image bearer by establishing the discharge between the discharge electrode and the latent-image bearer, a grid power supply (e.g., the grid power supply 17) configured to feed a grid bias to be applied to the grid electrode with constant voltage control, and a control unit (e.g., the main control unit 100) configured to perform a grid determining process which determines a grid setpoint value, which is an output setpoint value for the constant voltage control of the grid bias, includes a surface potential detector (e.g., the surface potential sensor 3) configured to output a result of detecting a surface potential of the latent-image bearer on which charge is deposited by the discharge. The control unit is configured to perform a charging-current determining process which determines a charging-current setpoint value, which is an output setpoint value for the constant current control of the charging bias, based on a difference between the result of detection output from the surface potential detector and the grid setpoint value at predetermined timing.

With this configuration, when the surface of the latent-image bearer is not worn severely yet and an environment has not changed to a low-temperature and low-humidity environment, charge is favorably deposited on the latent-image bearer, and a charging potential close to the grid setpoint value is obtained. By contrast, if the surface of the latent-image bearer is worn severely or if the environment has changed to a low-temperature and low-humidity environment, charge cannot be deposited on the latent-image bearer to a desired potential even if the grid setpoint value is adjusted. As a result, the difference between a detection result of the charging potential output from the surface potential detector and the grid setpoint value increases. The control unit determines the charging-current setpoint value based on the difference. More specifically, when the surface of the latent-image bearer is not worn severely yet and the environment has not changed to a low-temperature and low-humidity environment, the difference is relatively small. When the difference is relatively small as such, the control unit sets a relatively small value as the charging-current setpoint value. Consequently, depositing charge on the latent-image bearer to a desired potential to obtain a desired image density can be attained while avoiding generation of unnecessary ozone and waste of energy. By contrast, when the surface of the latent-image bearer is worn severely or the environment has changed to a low-temperature and low-humidity environment, the difference is relatively large. When the difference is relatively large as such, the control unit sets a relatively large value as the charging-current setpoint value. Consequently, depositing charge on the latent-image bearer to a desired potential to obtain a desired image density is attained even when the latent-image bearer is worn severely or the environment has changed to a low-temperature and low-humidity environment. Thus, the charging device is capable of depositing charge on the latent-image bearer to a desired charging potential while avoiding generation of unnecessary ozone and waste of energy and, simultaneously, obtaining stable image density independently of an environment.

Aspect B

The aspect B has a configuration that, for the aspect A, the control unit is configured to perform, in the grid determining process, a process of determining the grid setpoint value based on a difference between a target charging potential of the latent-image bearer and the result of detection.

With this configuration, in contrast to the image forming apparatus disclosed in Japanese Laid-open Patent Application No. H4-163565, a proper value of the grid setpoint value can be obtained based on the difference between the detection result output from the surface potential detector and the target charging potential without adding an electric-current detector for detecting an electric current flowing from the charging device to the latent-image bearer.

Aspect C

The aspect C has a configuration that, for the aspect A or aspect B, the control unit is configured to perform, after performing the charging-current determining process and before performing an image forming process in accordance with user's instruction, a process of determining whether or not to perform the grid determining process based on a difference between the target charging potential and the result of detection and, upon determining to perform the grid determining process, performing the image forming process after performing the grid determining process.

With this configuration, if the charging-current setpoint value is changed (updated) from its previous value by the charging-current determining process, the image forming process is performed after the grid setpoint value has been changed to a value suitable for the updated charging-current setpoint value. Accordingly, degradation in image quality which would otherwise occur if the image forming process was performed with the grid setpoint value unchanged from a value unsuitable for the updated charging-current setpoint value.

Aspect D

The aspect D has a configuration that, for the aspect C, the control unit is configured to perform, prior to performing the image forming process, the charging-current determining process before performing the grid determining process.

With this configuration, as in the case of the printer according to the implementation example, downtime of the apparatus can be shortened as compared to the configuration in which the charging-current determining process is performed after the grid determining process.

Aspect E

The aspect E has a configuration that, for any one of the aspects A to D, the control unit is configured to perform an EOL determining process, the EOL determining process determining whether or not the latent-image bearer has reached end of usable life of the latent-image bearer based on a difference between a result of detection output from the surface potential detector after the charging-current determining process is performed and the grid setpoint value.

With this configuration, it is possible to obtain information about when the latent-image bearer has reached the EOL accurately based on the difference between the detection result output from the surface potential detector and the grid setpoint value.

Aspect F

The aspect F is directed to an image forming apparatus, and has a configuration that the image forming apparatus comprises a latent-image bearer; a charging unit configured to deposit charge on the latent-image bearer; a latent-image writing unit configured to write a latent image to the charged latent-image bearer; and a developing unit configured to develop the latent image, the image forming apparatus being characterized in using the charging device according to any one of the aspects A to E.

Aspect G

The aspect G is directed to an image forming method, and has a configuration that the image forming method comprises charging a latent-image bearer; writing a latent image to the charged latent-image bearer; and developing the latent image, wherein the charging is performed using the charging device according to any one of the aspects A to E.

According to an aspect of the present invention, a charging device is capable of depositing charge on an electrostatic latent bearer to a desired charging potential while avoiding generation of unnecessary ozone and waste of energy and, simultaneously, obtaining stable image density independently of an environment.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A charging device comprising:

a discharge electrode for establishing a discharge;

a grid electrode arranged between the discharge electrode and a latent-image bearer of an image forming apparatus;

a charging power supply configured to feed, with constant current control, a charging bias to be applied to the discharge electrode to deposit charge on a surface of the latent-image bearer by establishing the discharge between the discharge electrode and the latent-image bearer;

a grid power supply configured to feed a grid bias to be applied to the grid electrode with constant voltage control; and a control unit configured to perform a grid determining process, the grid determining process determining a grid setpoint value, the grid setpoint value being an output setpoint value for the constant voltage control of the grid bias, characterized in further comprising a surface potential detector configured to output a result of detecting a surface potential of the latent-image bearer where charge is deposited by the discharge, wherein the control unit is configured to perform a charging-current determining process, the charging-current determining process determining a charging-current setpoint value, the charging-current setpoint value being an output setpoint value for the constant current control of the charging bias, based on a difference between the result of detection output from the surface potential detector and the grid setpoint value at predetermined timing.

2. The charging device according to claim 1, wherein the control unit is configured to perform, in the grid determining process, a process of determining the grid setpoint value based on a difference between a target charging potential of the latent-image bearer and the result of detection.

3. The charging device according to claim 1, wherein the control unit is configured to perform, after performing the charging-current determining process and before performing an image forming process in accordance with user's instruction, a process of determining whether or not to perform the grid determining process based on a difference between the target charging potential of the latent-image bearer and the result of detection and, upon determining to perform the grid determining process, performing the image forming process after performing the grid determining process.

4. The charging device according to claim 3, wherein the control unit is configured to perform, prior to performing the image forming process, the charging-current determining process before performing the grid determining process.

5. The charging device according to claim 1, wherein the control unit is configured to perform an EOL determining process, the EOL determining process determining whether or not the latent-image bearer has reached end of usable life of the latent-image bearer based on a difference between a result of detection output from the surface potential detector after the charging-current determining process is performed and the grid setpoint value.

6. An image forming apparatus comprising:

a latent-image bearer;

a charging unit configured to deposit charge on the latent-image bearer;

a latent-image writing unit configured to write a latent image to the charged latent-image bearer; and a developing unit configured to develop the latent image, the image forming apparatus being characterized in using the charging device according to claim 1 as the charging unit.

7. An image forming method comprising:

charging a latent-image bearer;

writing a latent image to the charged latent-image bearer; and developing the latent image, wherein the charging is performed using the charging device according to claim 1.

* * * * *